US005823645A

United States Patent [19]

Darling

[11] Patent Number: 5,823,645

[45] Date of Patent: Oct. 20, 1998

[54] PORTABLE STORAGE COMPARTMENT

[76] Inventor: Sharon K. Darling, Rte. 3, Box 2162, Quincy, Fla. 32351

[21] Appl. No.: 874,502

[22] Filed: Jun. 13, 1997

Related U.S. Application Data

[63] Continuation-in-part of Ser. No. 605,728, Feb. 22, 1996, abandoned.

[51] Int. Cl.[6] ..... E06B 9/15

[52] U.S. Cl. ..... 312/297; 312/238; 160/118; 160/196.1; 160/229.1

[58] Field of Search ..... 312/297, 196, 312/238; 160/118, 235, 229.1, 196.1; 248/205.2, 467

[56] References Cited

U.S. PATENT DOCUMENTS

| | | | |
|---|---|---|---|
| 1,198,327 | 9/1916 | Clippard | 312/297 |
| 2,411,906 | 12/1946 | Skelly | 160/229.1 |
| 2,978,020 | 4/1961 | Paulsrude | 160/229.1 X |
| 3,137,027 | 6/1964 | Birkle | 160/196.1 X |
| 3,369,589 | 2/1968 | Benkert, Jr. | 160/196.1 X |
| 3,837,041 | 9/1974 | Modert et al. | 312/297 X |
| 4,279,454 | 7/1981 | Korso et al. | 312/297 |
| 4,332,287 | 6/1982 | Stolpe | 160/229.1 X |
| 4,667,353 | 5/1987 | Zeigler et al. | 160/118 X |
| 4,681,379 | 7/1987 | Pillinini | 312/297 |
| 4,834,161 | 5/1989 | Johnson et al. | 160/118 X |
| 5,121,974 | 6/1992 | Monson | 312/297 X |
| 5,295,527 | 3/1994 | West | 160/349.2 X |
| 5,551,657 | 9/1996 | Liethen | 248/205.2 |
| 5,588,723 | 12/1996 | Sivin | 312/238 X |

FOREIGN PATENT DOCUMENTS

| | | | |
|---|---|---|---|
| 467979 | 4/1914 | France | 160/118 |
| 9871 | 4/1911 | United Kingdom | 312/297 |

*Primary Examiner*—Peter M. Cuomo
*Assistant Examiner*—James O. Hansen
*Attorney, Agent, or Firm*—Carnes, Cona & Dixon

[57] ABSTRACT

The present invention is a portable storage compartment which is adapted to be removably secured to the under surface of an existing upper cabinet. The storage compartment of the present invention includes an upper frame and a tracking system which is secured to a collapsible and foldable screen. The tracking system is secured to the screen and is also received within the frame. This will enable the screen to be slideably located on the frame. The screen is multi-paneled and comprises a plurality of rigid panels and flexible panels, alternatively disposed. This alteration of rigid and flexible panels provide a device which is designed and configured to be customized by the user by enabling the user to adjust the width of the screen by either cutting the off a flexible panel or by slidably removing a panel. The present invention will successfully, conveniently and aesthetically stored items on a counter while freeing space in the conventional cabinets and drawers located in the kitchen, garage, laundry room, or the like.

20 Claims, 5 Drawing Sheets

PORTABLE STORAGE COMPARTMENT

This is continuation-in-part of application Ser. No. 08/605,728, now abandoned.

BACKGROUND OF THE INVENTION

1. Field of the Invention

The present invention relates generally to a storage compartment device and more particularly to a portable storage compartment, having a slidable screen attached thereto, that is adapted to be removably secured to an under surface, such as the under surface of an existing upper cabinet, book shelf or the like. Additionally, the present invention includes a unique elbow means for allowing the user to easily and successfully manipulate the slidable screen of the storage compartment, even if the present invention includes a substantially rectangular configuration, inherently rendering the screen to travel around a bend.

2. Description of the Prior Art

For years individuals have relied on counter space in a kitchen for storing and maintaining appliances, such as blenders, coffee makers, and the like. This arrangement will enable the appliances to be easily accessible to the residence of the home. Counters in kitchens are also used for storing and maintaining food products, such as fruits, vegetables, chips, or the like. This arrangement will, like the appliances, provide easy accessibility to the edible items. At times, these items located on the counter will give the appearance of clutter, rending the room to seem messy and untidy.

Accordingly, efforts have been made to provide for an aesthetically pleasing means for camouflaging items on a kitchen counter. Such means that is commonly done is to provide a cover for a particular item. Typically, this cover is commonly used for appliances and is fabricated from a cloth or cloth like material. Though adequate in covering the item and protecting the appliance from dust, grease, and debris, the cover will still enable individuals to recognize the item being cover, inherently defeating its purpose. Additionally, the covers available on the market today are also limiting in design and styles, which in turn is limiting to the consumer.

Yet another commercially available product is a storage compartment, commonly known as an appliance garage, which is obtainable via cabinet makers or the like. These appliance garages are secured between the upper cabinets within a kitchen and the counter. The garages consists of two side walls and a front door located therebetween. The side walls are permanently affixed to the existing cabinets and counter, while the door is mounted on a door frame. The door is slideably mounted to the frame and is adapted to slide upwardly to expose the interior of the garage. Though efficient at hiding conventional appliances, these garages are expensive and can be difficult, if not impossible, to retrofit into an existing kitchen cabinet lay out. Since the height between the upper cabinet and counter can vary from kitchen to kitchen, these storage compartments must be customized per kitchen which inherently adds to the expense of the garage. Further still, since the side wall and frame are permanently attached to the existing upper cabinet and counter, cleaning inside the garage is awkward and difficult.

Hiding clutter or having privacy is a common concern to many individuals. Since costs and versatility are deciding factors for many consumers, various products have been develop with those particular concerns in mind. One popular product which provides privacy at a reasonable price, and offers a means of concealing, is the multi-panel folding door. Such a door is disclosed in British Patent No. 846,242 issued to Paulsrude et al. This door device, like the ones commercially available today, includes a header and side members which are attachable to a door frame. A track is located on the header. Slidably mounted within the track is a foldable screen. This device, like the conventional models, is ideal for use within a doorway. Unfortunately, this product, like the ones available on the market today, fail to disclose a means of allowing the screen to slide smoothly around a corner. Additionally, the use of the header and side members provides a device which is bulky and difficult to maneuver and install in small areas. Further, this device, like the others, does not disclose a compact nor portable unit which is easy to use and which can be customized by the consumer.

Accordingly, none of these previous efforts provide the benefits intended with the present invention, such as providing a storage compartment that can be removably secured to an upper cabinet or the like. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a storage compartment that is adapted to be removably secured to an under surface, such as the under surface of an existing upper cabinet, book case, self, or the like. The storage compartment of the present invention includes an upper frame and a tracking means which is secured to a screen means. The upper frame is secured to the desirable under surface and will receive the tracking means. This arrangement will allow the screen means to slide from an open position, for revealing the encompassed space defined by the frame, to a closed position, for concealing the items within the encompassed space.

The upper frame includes various components which are interlocking with each other. Each component has a substantially closed or C-shape configuration having a top planar surface with opposite ends and curved walls extending downwardly from each opposite end. The top planar surface is adapted to be secured to the particular under surface, such as the under surface of an existing upper cabinet, book case, self, or the like.

Each component of the frame includes mating means for allowing the frame to interlock properly. The frame comprises at least one elongate member and at least one elbow member. The use of the elongated member and elbow provides a frame which can be customized to include a perpendicular portion. The perpendicular portion will provide for a device which allows smooth transition of the screen means on the frame, even at a right angle.

The tracking means is secured to the screen means and is also adapted to be received within the frame. This will enable the screen means to be slideably attached to the frame.

The screen means is structured so as to slide on the frame. As a result, this screen means must be fabricated so as to be collapsible as well as being compact when in a closed and folded position. The screen is multi-paneled and comprises a plurality of rigid panels and flexible panels, alternatively disposed. This alteration of rigid and flexible panels provide a device which is designed and configured to be customized by the user by enabling the user to adjust the width of the screen by either cutting off a flexible panel or by slidably removing a unit. A unit comprises a flexible panel secured to a rigid panel.

Accordingly, it is the object of the present invention to provide for a storage compartment that will overcome the drawbacks, disadvantages, and shortcomings of prior storage compartments and methods thereof.

It is yet another object of the present invention to provide for a storage compartment which will adequately and efficiently conceal a multiplicity of items, such as, but not limited to, compact kitchen appliances (i.e. blenders, coffee makers, bread machine, food processor, etc.), televisions, computers, children's tools, offices supplies, and the like. Further this invention will provide for a storage compartment which will not be secured to the surface maintaining the particular item(s) to be conceal, so as to provide a device that is non-obtrusive which will enable easy removal and replacement of the stored item(s) as well as offer accessibility and cleaning capacity to the space defined by the frame.

Still a further object of the present invention is to provide for a storage compartment that can be retrofitted and customized below any existing and conventional shelving or elevated cabinet for providing a device which offers extra storage while concealing the items being stored. The final product is an aesthetically pleasing storage unit.

It is still a further object of the present invention to provide for a portable storage compartment which will successfully, conveniently and aesthetically store items on a surface, such as a counter or self, for freeing space in the conventional cabinets, drawers or self located typically in the kitchen, garage, laundry room, or the like.

Another object of the present invention is to provide for a storage compartment which will enable the user to open the screen means for temporarily unveiling additional counter and/or space when desirable.

Still a further object of the present invention is to provide for a storage compartment which includes a frame having an elbow for allowing the frame to extend around a corner and to provide for a smooth transition of the screen along the frame.

Yet another object of the present invention, to be specifically enumerated herein, is to provide a storage compartment in accordance with the preceding objects and which will conform to conventional forms of manufacture, be of simple construction and easy to use so as to provide a device that would be economically feasible, long lasting and relatively trouble free in operation.

Although there have been inventions related to storage devices, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
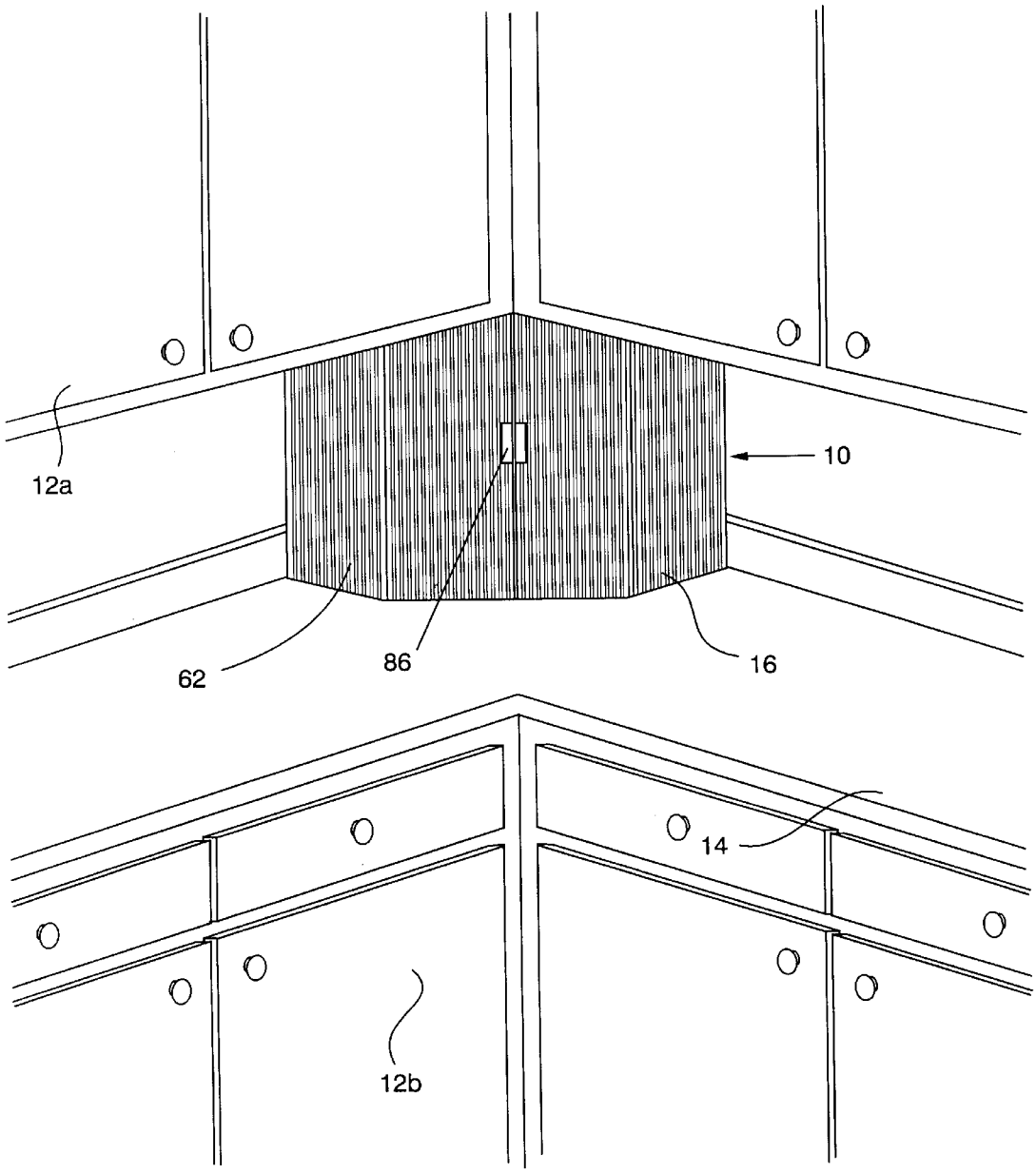
FIG. 1 is a front perspective view of the storage compartment of the present invention secured to the under surface of an existing cabinet.

As seen in FIG. 1, the present invention comprises a storage compartment 10 that is adapted to be removably secured to the upper surface, such as a book case, self, or, as illustrated, an upper cabinet 12*a*. In this example, the device 10 will be located between the upper and lower cabinets 12*a* and 12*b*, respectively. The design and configuration of this storage compartment will provide for a device 10 that can aesthetically conceal items located on a counter top 14, or optionally, on a self or the like.

The present system has been employed successfully in the kitchen environment. For illustrative purposes, it will be illustrated the method for utilizing the present invention in the above identified environment. It is noted that this storage compartment can easily be retrofitted into a multiplicity of environments, including, but not limited to, book selves, desks, or the like.

The storage compartment includes a screen 16 that is slidably mounted to a frame 18. The frame 18 includes several components and is illustrated in further detail in figures in FIGS. 2*a*–3*c*. As seen in FIGS. 1–3*c*, this frame 18 is adapted to be secured to the lower surface of the upper cabinet 12*a*, as illustrated, a self, or the like. Thereby the countertop, or the resting surface, is not effected by this tracking system. This will eliminate any possibility of damaging the counter 14 or resting surface.

As seen in FIGS. 2*a*–3*c*, the frame 18 includes at least one elongated member 20 and at least one elbow 22. The elongated member 20, as shown, is straight and planar and includes opposite ends. For illustrative purposes, one end 24 is shown. The elbow is L-shape and, like the elongated member, includes opposite ends 26 and 28, respectively.

These ends 24, 26, and 28 located on the elongated member 20 and elbow 22 are designed and configured to interlock with each other. Inherently providing a device which can be customized. As seen in FIG. 1, the frame includes one elongated member and two elbows to provide for the device of the present invention to be attached angularly. The elbows will allow for a storage compartment to include a substantially rectangular configuration.

Located on each end of the elongated member, as seen in FIGS. 2*a*–3*c*, is a male extending means 30. Optionally this elongated member can include a male extending means on one end and a female extending means on the opposite ends.

The male extending means 30 is an extension of the elongated member, but which is smaller in size so as to be received easily within a female receiving means 32 of the elbow or optionally, other elongated member.

Figure 2A:
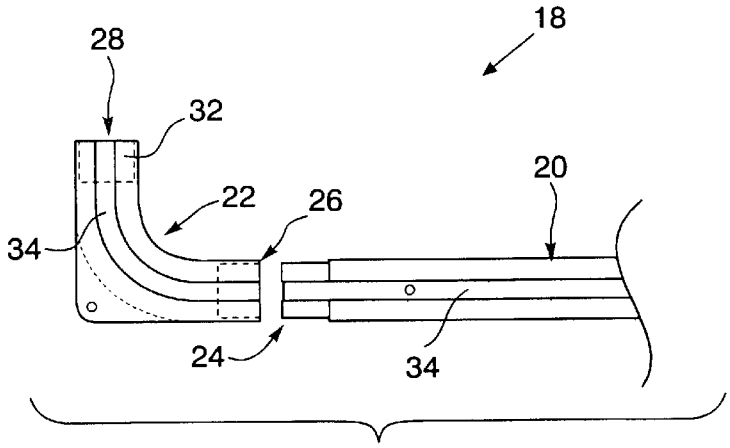
FIG. 2*a* is a bottom view of an elongated member and elbow member of the frame, in a non-assembled position used in the storage compartment of the present invention.
Figure 2B:
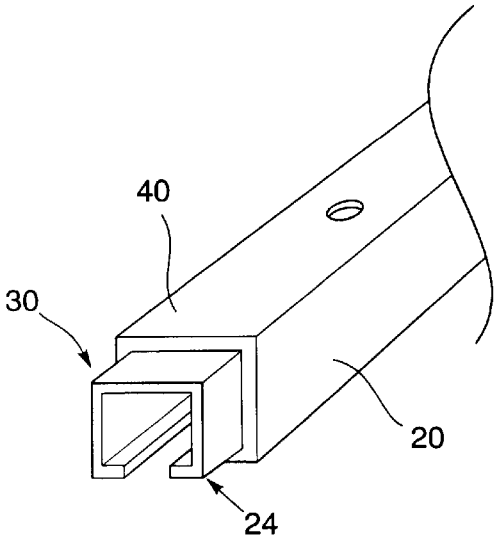
FIG. 2*b* is a end perspective view of the elongated member of the frame used in the storage compartment of the present invention.

The female receiving means 32, illustrated in outline in FIG. 2*a*, is an opened end of the elbow and/or elongated member.

Each member includes a channel 34 that is defined by side walls 36. Each side wall 36 includes an extension or tab 38. A top wall 40 contacts the lower surface of the upper cabinet 12*a*. This top wall 40 will maintain and secure a securing means to enable the attachment of the frame to the cabinet. As seen, the channel 34 extends into each extension or male extending means 30. This will provide for the track to be continuous via channel 34 for preventing a stuck or malfunction while the screen is in transition within the channel.

As shown in the drawings, the female receiving means 32 is substantially identical in shape and structure as the channel, except it is larger in size. This design will provide for the male extension portion 30 to be received within the female receiving portion 32 to provide for the top wall 40 of each component to be linear and co-planar as well as providing for the channel 34 to properly aligned.

This frame can be fabricated from any durable material, such as aluminum, plastic, or the like. The frame can be packaged as a plurality of individual elongated frame members and a plurality of elbows. The elongated frame members can come in a variety of lengths so as to provide a device which can be customized according to the consumers needs and desires. Providing an assembly including a plurality of frame members having varied lengths and elbows of various angles provides for a user friendly device which is compact and portable.

The frame can be assembled prior to attaching it to the under surface of the upper cabinet or the like. In order to accomplish this, the ends are secured to each other via the male extending means 30 and female receiving means 32. The male extending means further include the channel 34 to provide for a continuous flow of the channel. This will provide for a smooth and non-intrusive transition of the screen means. By using the various sized elongated members 20 and optionally, the elbow 22, the user can obtained the desired shape and sized cabinet. Consequently forming a customized storage unit.

Figure 2C:
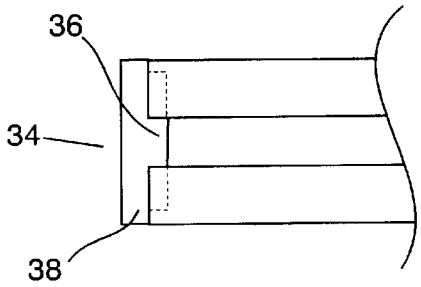
FIG. 2*c* is an end view of the elbow of the frame used in the storage compartment of the present invention.

An end cap 42 can be inserted within the end of the female receiving means or the male extending means. The end cap is illustrated in FIG. 2*c* as being inserted into a female receiving means 32. The end cap 42 includes a front portion 44 and a rear portion 46. The front portion extends into the receiving means while the rear portion acts as a stop to prevent the cap from extending entirely into each channel. The front portion 44 is adapted to be received in the channel 34 to render the end cap to be snugly located within the channel 34 of the frame 18. The rear portion 46 of the plug will be flush with the outer ends of the frame 18 for rendering not only an attractive product but also a safe product which will cover the edges of the frame thereby eliminating any danger associated with contact with the edge, such as cuts or the like. This end cap can be fabricated from a polymer, such as rubber, and can be used for protecting the wall from scratches or the like which could occur with the ends of the frame or with the screen.

Figure 3A:
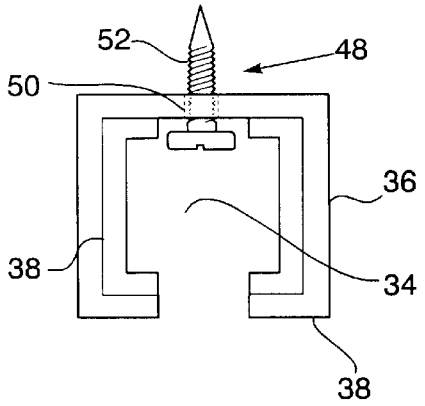
FIG. 3*a* is a side view of an example of the securing means for securing the frame to a surface.
Figure 3B:
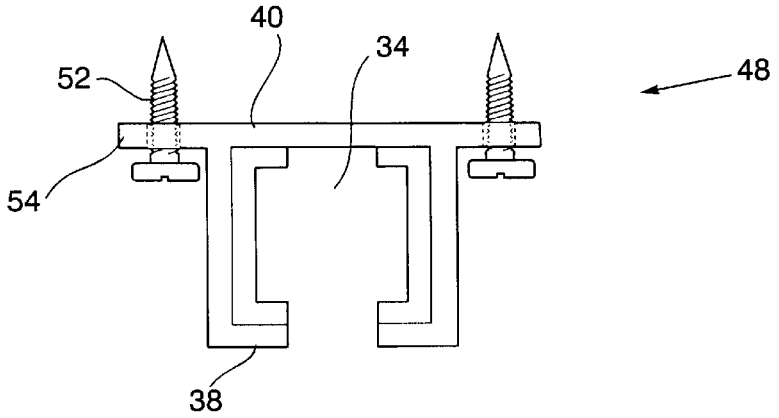
FIG. 3*b* is a side view of another example of the securing means for curing the frame when the frame includes a flange member.
Figure 3C:
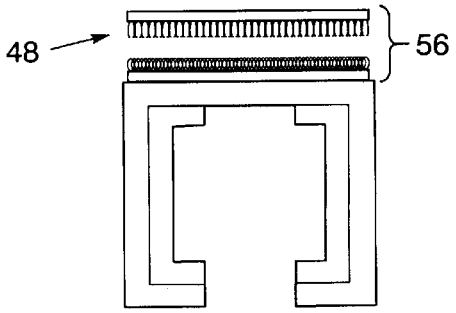
FIG. 3*c* is a side view of another example of the securing means for securing the frame to a surface.

The frame is secured to the under surface of the upper cabinet, as illustrated, self, or the like, via a securing means 48. This securing means can comprise any conventional securing means. Examples of the various securing means are illustrated in FIGS. 3*a*–3*c*. As seen in FIG. 3*a*, the securing means 48 can provide for an a plurality of evenly spaced apertures 50 to extend through the top wall 40 of the track 18. These apertures can receive screws 52 for enabling the device to be secured to a particular surface, such as the under surface of a conventional cabinet. This type of securing means is ideal for use with a wooden surface.

Figure 2D:
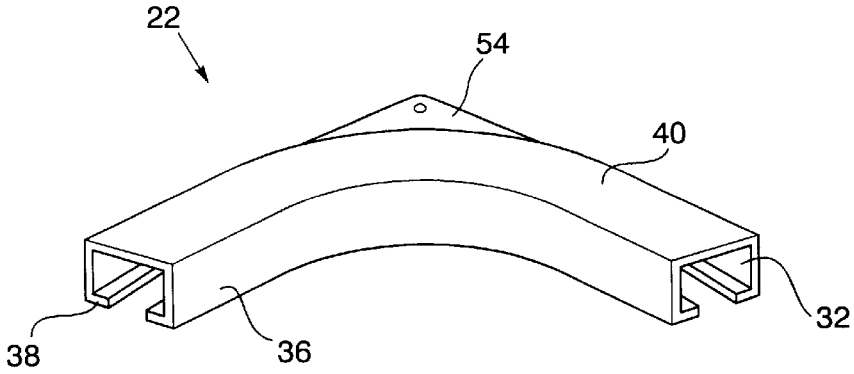
FIG. 2*d* is a perspective detail view of the elbow of the frame used in the storage compartment of the present invention.

Optionally, these apertures can be located through flanges 54 which extend outwardly from the top surface 40 of each component of the frame 18. Each flange 54 includes an aperture 56. The flange 54 of the elbow 22 is illustrated in FIG. 2*d*. This flange 54 is further illustrated in the cross-sectional view of the elongated member shown in FIG. 3*b*. By providing flanges 54 renders a device which is easy to install, thereby eliminating attaching the frame by way of the channel 34.

For individuals not wishing to alter their existing surfaces, yet another example is illustrated in FIG. 3*c*. As seen in this figure, hook and loop material (Velcro) 56 can be secured to both the top wall 40 of the track 18 and the under surface of the upper cabinet 12*a*. This design and configuration will render easy installation of the frame 18. Though not illustrated, other conventional forms of securing can be utilized, these forms include, but are not limited to, adhesives, double sided tapes, or the like.

The channel 34 of the frame is adapted to receive the tracking or sliding mechanism of the curtain. This sliding mechanism is constructed to slide freely within the channel. To prevent accidental removal or slippage of the sliding mechanism, the opposite ends of the frame can be provide with plugs 42. These plugs will provide for a natural stop for the sliding mechanisms. The plugs are only utilized when necessary, such as when an end of a frame is not contacting a wall or side wall of a cabinet.

A plug is illustrated in further detail in FIGS. 2*c*. It is noted that only one plug is illustrate and that a second plug is not illustrated in further detail since it would be substantially identical in structure and design as with the first plug.

Figure 4A:
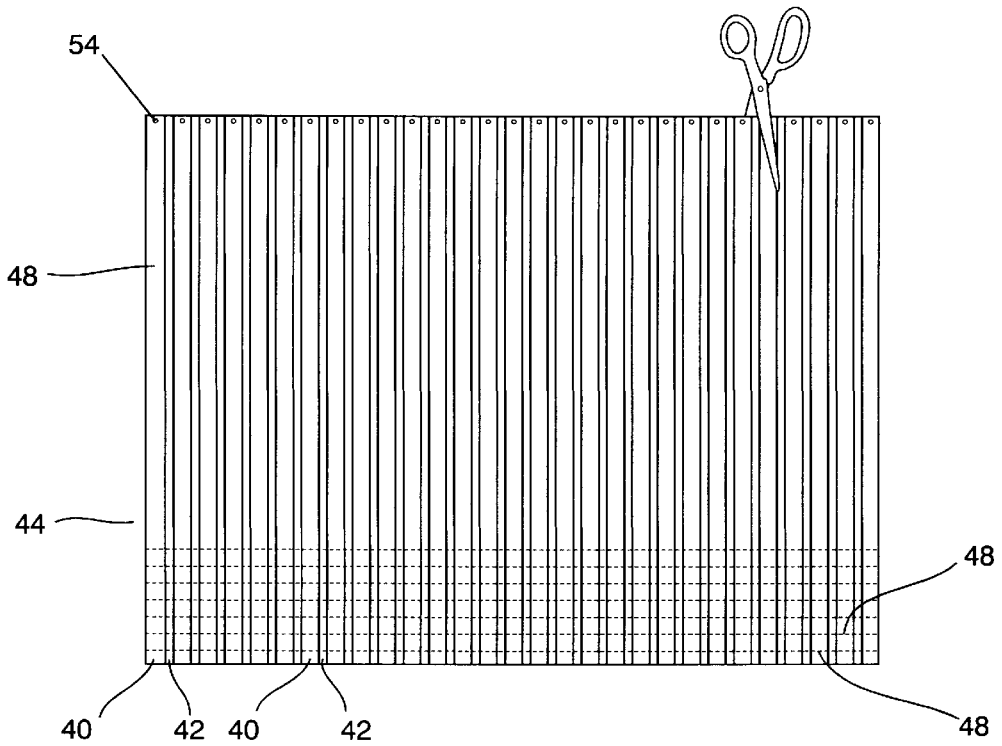
FIG. 4*a* is a front plan view of the first embodiment of the screen used in the storage compartment of the present invention.
Figure 4B:
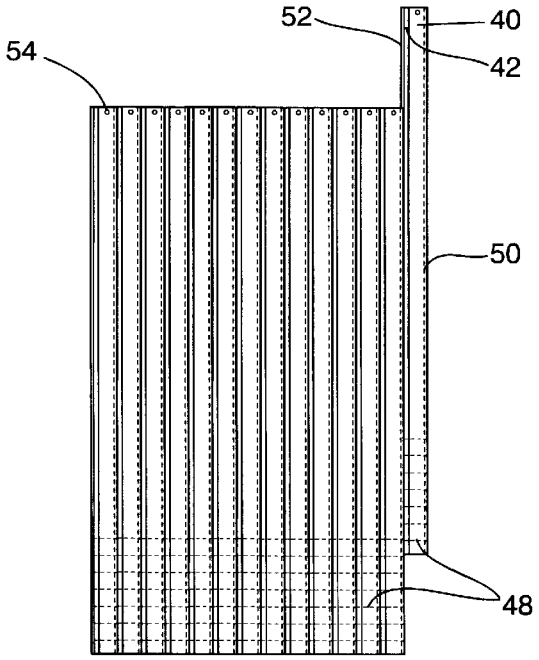
FIG. 4*b* is a front plan view of the second embodiment of the screen used in the storage compartment of the present invention.

The screen 16 is illustrated in further detail in FIGS. 1 and 4*a*–4*b*. As seen in these figures, the screen can is fabricated from a plurality of panels, alternating from a rigid panel 56 to a flexible panel 58. This alteration of material will provide for a device that is easily collapsible. As such, the rigid panel is wider than the flexible panel.

The lower edge of the screen is also designed not to contact the counter or lower surface. Hence, eliminating any need for a lower frame and also inherently providing for a gap to be located between the screen and the lower surface. This will eliminate the possibility of damaging the counter.

Each panel 56 and 58 includes a back surface 60 and a front surface 62. The front surface 62 is exposes in a closed position (see FIGS. 1 and 6). The back surface will be facing the items stored.

The back surface 60 can includes a plurality of evenly spaced markings 64. These markings are an indicating means for enabling the user to cut and customized the product efficiently and effectively. Accordingly, this will provide for the screen that can be customized in length.

The width of the screen 16 can also be adjusted. This adjustment can be accomplished by cutting at the flexible panel 58 at the appropriate distant (see FIG. 4*a*).

Optionally, flexible panel 58 can be slidably secured to a rigid panel 56, as seen in FIG. 4*b*. Hence, this will provide for one side of the rigid panel to be secured and attached to the flexible panel while the opposite side of the rigid panel 56 includes a channel 66 (illustrated in outline). This channel 66 is adapted to receive an extender 68 located on the flexible panel 58 for enabling the flexible panel 58 to be slidably located on the rigid panel. This extender is substantially rigid and is perpendicularly located on the flexible panel.

As seen in this figure, one side of the flexible panel is secured to a rigid panel while the opposite side includes the extender. This will provide for the flexible panel and rigid panel to be connected for forming a unit. This unit is designed to be slideably secured to other units. As shown in the drawings, the unit is an unitary and single member structure. This design and configuration of each unit will prohibit the flexible member from being removable from the rigid member per individual unit. Inherently decreasing the number of components for successfully employing the storage compartment of the present invention.

The use of both a flexible panel and a rigid panel provide a device for a screen which is collapsible. The flexible member bends as the device is opened. This will provide for front surface of a preceding rigid panel to contact the front surface of the succeeding rigid panel. The front surface of the preceding rigid panel will contact the front surface of the succeeding rigid panel, inherently providing for a collapsible screen.

Figure 7A:
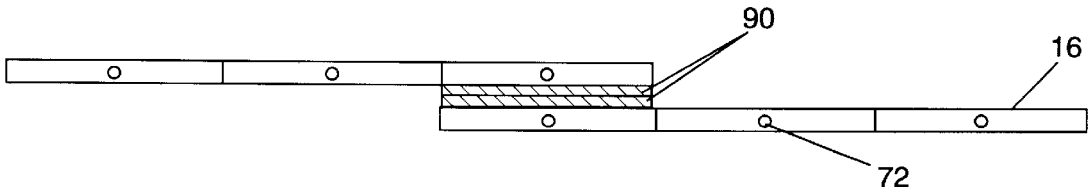
FIG. 7*a* is a top plan view of the first embodiment of the closure means of the present invention.
Figure 7B:
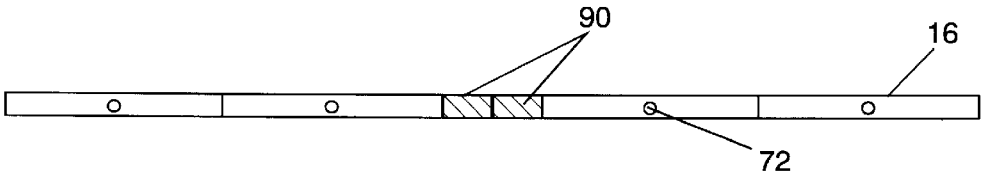
FIG. 7*b* is a top plan view of the second embodiment of the closure means of the present invention.

At least two of the rigid panels will include a closing means (see FIG. 1). This closing means is illustrated and discussed in further detail in FIGS. 7*a* and 7*b*.

Figure 5:
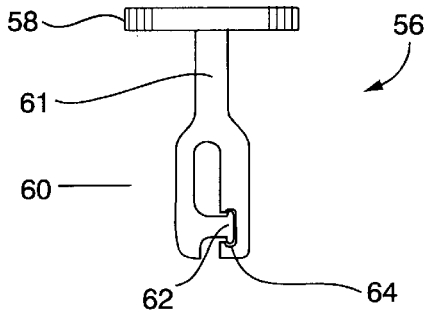
FIG. 5 is a side view of the sliding mechanism used in the storage compartment of the present invention.

The sliding mechanism can be integral with each panel so as to provide for the sliding mechanism to extend upwardly from the top edge of each rigid panel. Optionally, opening 70 is located in the proximity of the upper edge of each rigid panel 56 so as to enable the sliding mechanism to be secured thereto. The sliding mechanism is illustrated in further detail in FIG. 5. As seen the sliding mechanism 72 includes an upper portion 74 and a lower portion 76. The upper portion is located within the channel of the frame. The lower portion includes an extension 78 that is adapted to extend into each opening and be secured in a fixed position within groove 80. This will provide for the extension to snap into a secured position within the groove. It is noted that the extension is illustrated as being enlarged. However, the extension can include any size or configuration so as to be received securely within the groove 80.

As stated previously, the sliding mechanism can be integral with the upper edge of the panel. This will provide for the shaft 82 of the sliding mechanism to extend upwardly from the top edge of each rigid panel for rending the upper portion 74 to be received within the channel. Thereby eliminating the use of the openings and the lower portion 76 of sliding mechanism.

This device is ideal for kitchens. Once secured on the lower surface of the upper cabinets, the user will still be able to clean their counter tops efficiently. The frame is not secured to the counter top, but rather to the lower surface of the upper cabinet. This will provide for the lower edge of the screen to not engage with the counter top, inherently enabling proficient cleaning within the garage as well and avoiding scratches and other permanent marking on the counter surface. By utilizing a continuous channel which extends into the interlocking means (male extending portion) provides a device which will efficiently allow the sliding mechanism to travel therein. Further, the elbow allows smooth transition of the sliding mechanism, even around a curved or angled frame. Due to the unique design of the frame member and tracking means, it is seen that the present invention is a product which is easily customized by the consumer and is adapted to be located anywhere, even between upper and lower shelves.

Figure 6:
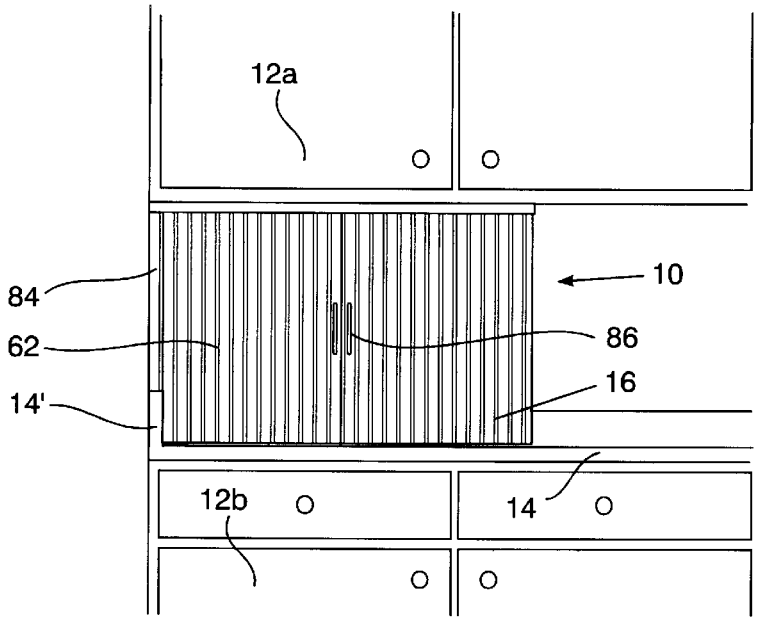
FIG. 6 is a front view of an alternative embodiment of the storage compartment of the present invention, including a spacer.

As seen in FIG. 6, the storage device of the present invention can be adapted to be utilized with counters that are equipped with back splashes, commonly used with laminate counter tops. As seen in this figure, the back splash 14' limits the screen from being flush with the side wall of the counter. This will provide for a gap to exist between the last panel of the screen 16 and the edge of the wall, inherently providing for a non-aesthetically pleasing affect.

To eliminate this gap, a shim or spacer 84 can be provided for enabling the user to attach the shim or spacer 84 to the side wall. This will not only eliminate the gap, but will provide for an aesthetically pleasing garage. This spacer 84 can be secured to the side wall of the kitchen via any conventional attaching means, such as, but not limited to adhesives, epoxies, VELCRO (hook and loop material), tape, or the like.

Yet another means for eliminating this gap would be to cut the last panel shorter so as to enable this last panel or a portion of the last panel to be located above the back splash 14'.

The closing means is utilized for enabling the garage to remain in a closed and stored position when items are being stored. This will enable items to be out of view, so as to provide for an area that is neat and clutter free. In order to provide for the screen to remain in a closed and secure position, the garage is provide with a closure means 86. This closure means is illustrated in further detail in FIGS. 1, 6 and 7. As seen in these figures, the closure means includes handles 88 located exteriorly on the screen. Located on the edge of two of the panels are magnets 90 (see FIG. 7*b*). These magnets are adapted to engage each other for providing the device to be in a closed position. Optionally, one magnet can be placed on an outer surface while the second can be placed on an inner surface so as to provide for one side of the screen to over lap a second side of the screen (see FIG. 7*a*).

In order to utilize the garage of the present invention, the user merely cuts the frame to the desired and appropriate size. The frame is secured to the lower surface of a cabinet or upper shelf via the securing means. This frame defines the storage area. The screen is then adjusted to a certain length and width. The tracking means is secure to the screen and then slid into the frame. If a spacer is to be utilized, then the spacer is attached to the side wall. Hence, the garage is adapted to be used for storing and maintaining items. Accordingly, the garage of the present invention provides a device that is easy to use, useful and renders an aesthetically pleasing environment.

While the invention has been particularly shown and described with reference to an embodiment thereof, it will be understood by those skilled in the art that various changes in form and detail may be made without departing from the spirit and scope of the invention.

I claim:

1. A portable storage compartment in combination with an upper and lower cabinet or shelf having a lower surface which can maintain and support at least one item for concealing, said portable storage compartment comprising:

a frame member being secured to an under surface of an upper cabinet or shelf via a securing means;

said frame member having a plurality of components;

said components includes at least one elongated member and at least one elbow;

each of said components include an interlocking means for allowing a preceding member to interlock with a successor member;

a channel is located within each member;

said interlocking means includes said channel;

a collapsible and foldable screen is slideably secured to said frame via a tracking means for providing said collapsible and foldable screen to extend downwardly from said frame member and towards a lower surface which has the capability of maintaining an item for concealing, and to be located in close proximity to said lower surface but not contacting said lower surface;

a gap is located between said collapsible and foldable screen and said lower surface for preventing damage to occur to said collapsible and foldable screen and said lower surface.

2. A portable storage compartment as in claim 1 wherein a closure means is located on said screen for enabling said screen to be in a closed and secured position when not in use.

3. A portable storage compartment as in claim 2 wherein said closure means further includes handles.

4. A portable storage compartment as in claim 1 wherein said collapsible and foldable screen comprises alternating rigid panels and flexible panels, said rigid panels are larger in width than said flexible panels.

5. A portable storage compartment as in claim 4 wherein said screen includes a front surface and a back surface and said back surface includes a plurality of evenly spaced and horizontally disposed markings for enabling a user to cut the screen to a desired length.

6. A portable storage compartment as in claim 4 wherein said width of said screen can be altered via an alternating means.

7. A portable storage compartment as in claim 4 wherein one rigid panel is secured to one flexible panel for forming a unit, a plurality of units provide for said screen, each rigid panel includes a first end and a second end and each flexible panel includes a first end and a second end, each unit further includes said first end of said rigid panel to include a channel, said second end of said rigid panel is secured to said first end of said flexible panel, and said second end of said flexible panel includes an extender, said extender of a preceding unit is slidably inserted into said channel of a successor unit for providing said channel and said extender to form said alternating means.

8. A portable storage compartment as in claim 4 wherein a sliding mechanism extends into said channel from said collapsible and foldable screen and said sliding mechanism is removably secured to said screen.

9. A portable storage compartment as in claim 1 wherein said frame member includes opposite ends and a plug is removably secured within each exposed end of said frame member for retaining said tracking means within said frame member.

10. A portable storage compartment as in claim 1 wherein a sliding mechanism extends into said channel from said collapsible and foldable screen and said sliding mechanism is removably secured to said screen.

11. A portable storage compartment as in claim 10 wherein said sliding mechanism includes an upper portion and a lower portion, said upper portion is received in said channel, said lower portion is secured to said screen, and a shaft is located between said upper portion and said lower portion.

12. A portable storage compartment as in claim 1 further comprising a spacer which is secured to a side wall and above a back splash of said lower surface via an attaching means for enabling said screen to contact said spacer.

13. A portable storage compartment as in claim 1 wherein said closure means includes magnets.

14. A portable storage compartment as in claim 1 wherein each component includes a flange extending outwardly therefrom and said securing means is located in said flange.

15. A portable storage compartment as in claim 14 wherein said securing means is an aperture extending into each flange and said aperture receives a screw.

16. A portable storage compartment in combination with an upper and lower cabinet or shelf having a lower surface which can maintain and support at least one item for concealing, said portable storage compartment comprising:

a frame member being secured to an under surface of an upper cabinet or shelf via a securing means;

said frame member having a plurality of components;

said components includes at least one elongated member and at least one elbow;

each of said components include an interlocking means for allowing a preceding member to interlock with a successor member;

a channel is located within each member;

said interlocking means includes said channel;

a collapsible and foldable screen is slideably secured to said frame via a tracking means for providing said collapsible and foldable screen to extend downwardly from said frame member and towards a lower surface which has the capability of maintaining an item for concealing, and to be located in close proximity to said lower surface but not contacting said lower surface;

one rigid panel is secured to one flexible panel for forming a unit;

said unit is unitary and single structure;

a plurality of units provide for said screen;

a gap is located between said collapsible and foldable screen and said lower surface for preventing damage to occur to said collapsible and foldable screen and said lower surface.

17. A portable storage compartment as in claim 16 wherein said width of said screen can be altered via an alternating means, each rigid panel includes a first end and a second end and each flexible panel includes a first end and a second end, each unit further includes said first end of said rigid panel to include a channel, said second end of said rigid panel is secured to said first end of said flexible panel for forming a unitary structure, and said second end of said flexible panel includes an extender, said extender of a preceding unit is slidable inserted into said channel of a successor unit for providing said channel and said extender to form said alternating means.

18. A portable storage compartment as in claim 16 wherein a closure means is located on said screen for enabling said screen to be in a closed and secured position when not in use.

19. A portable storage compartment as in claim 16 wherein said rigid panels are larger in width than said flexible panels.

20. A portable storage compartment as in claim 16 wherein each component includes a flange extending outwardly therefrom and said securing means is located in said flange.

* * * * *